United States Patent [19]

Hemminger

[11] 4,015,793

[45] Apr. 5, 1977

[54] FILM TAKE-UP REEL

[75] Inventor: William F. Hemminger, Seaford, N.Y.

[73] Assignee: Pandick Press, Inc., New York, N.Y.

[22] Filed: Jan. 14, 1976

[21] Appl. No.: 649,061

[52] U.S. Cl. ..... 242/74

[51] Int. Cl.[2] ..... B65H 75/28

[58] Field of Search ..... 242/74, 78.3, 125.1; 197/175

[56] References Cited

UNITED STATES PATENTS

| | | | |
|---|---|---|---|
| 3,062,468 | 11/1962 | Brown | 242/74 |
| 3,204,888 | 9/1965 | Bernat | 242/74 |
| 3,648,944 | 3/1972 | Fujiwara | 242/74 |
| 3,840,196 | 10/1974 | Presentey | 242/74 |

*Primary Examiner*—Edward J. McCarthy
*Attorney, Agent, or Firm*—Pennie & Edmonds

[57] ABSTRACT

A film take-up reel having a longitudinal slot through the surface of said reel and a rotatable tightening shaft cooperating with said slot to secure the film to the reel. The tightening shaft has an effective diameter substantially less than that of the take-up reel and is located adjacent the slot through the surface of the reel. The tightening shaft also defines a slot entirely therethrough and cooperates with the slot in the take-up reel to impart several convolutions in the film to secure the film to the reel.

14 Claims, 7 Drawing Figures

FILM TAKE-UP REEL

BACKGROUND OF THE INVENTION

In the printing industry a phototypesetting process is one of the means used for printing various articles, reports, prospectus, etc. especially when speed is a factor. Typically, this process includes a camera for exposing film to letters or other figures which ultimately will appear as the printed material. The film is inserted into the camera on a load spool and passed across a plate where it is exposed to a screen which imparts to the film the desired letters or figures. From the plate the exposed film is passed through rollers to an exit slot where the film is rolled onto a film take-up reel exterior to the camera. The film take-up reels which have been used fit into a cassette adjacent the exit slot of the camera where the reels are secured to rotatable means in the cassette by an electric motor. The motor is in turn synchronized with the operation of the load spool such that as the film is passed through the camera the take-up reel will be rotated at the same rate as the film is being played off of the load spool.

To secure this film to the take-up reel the film is simply passed through a slot and the reel is manually rotated several revolutions until the film is wrapped around the reel a sufficient number of times so that it will not slip during operation of the camera. This method of securing film to the reel results in significant waste since that portion of the film on the reel is not available for exposure by the camera. Further, there is no uniformity as to the manner in which the film is secured to the take-up reel as each operator can use a diferent number of revolutions as he thinks are necessary. Consequently, the amount of film wasted is a function of the particular operator as well as the configuration of the take-up reel.

SUMMARY OF THE INVENTION

The invention relates to a film take-up reel having a hollow spool with a slot for receiving the film. Adjacent to the slot there is rotatably secured a tightening shaft which also has a slot for receiving the film. The tightening shaft cooperates with the spool slot to receive the film and secure the film to the reel by simply rotating the shaft.

More specifically, the slot in the shaft registers with the slot in the spool, and the shaft is located adjacent the inner surface of the spool to impart convolutions to the film when the shaft is rotated approximately a one-half revolution. A detent means is included to maintain the shaft in an open position for receiving the film and a closed position for securing the film to the spool. This configuration insures that only a predetermined amount of film is used in securing the film to the take-up reel. As a result the amount of film wasted on the take-up reel is significantly reduced and there is achieved a uniformity in the amount of film needed to secure the film to the device which is a function of the device configuration rather than the particular operator using the device.

DETAILED DESCRIPTION OF THE PREFERRED EMBODIMENT

Figure 1:
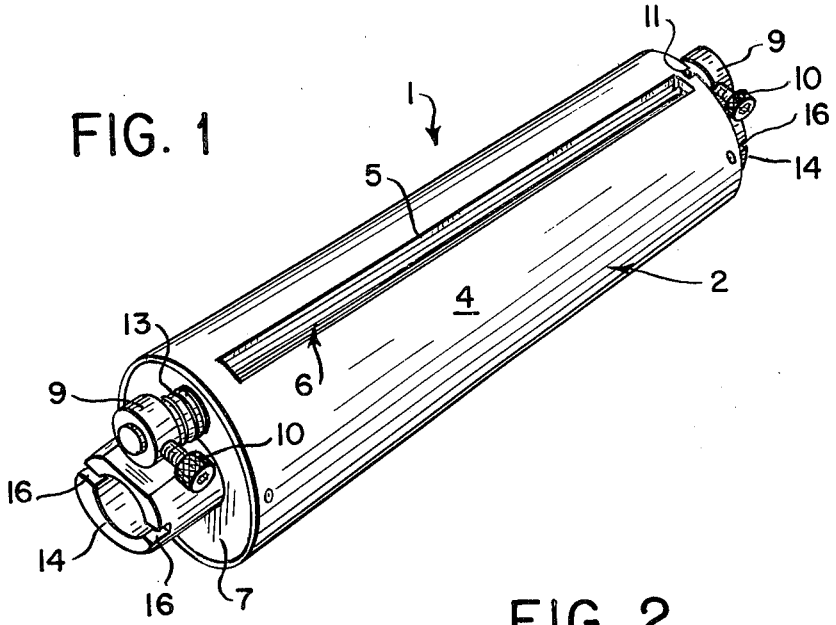
FIG. 1 is a perspective view of the film take-up reel.
Figure 5:
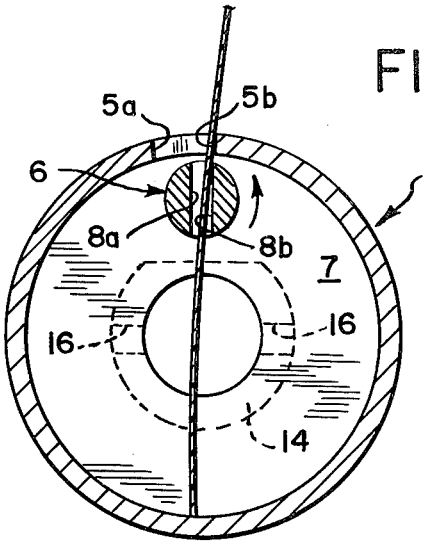
FIG. 5 is a sectional view of FIG. 2 taken along lines 5—5 showing the take-up reel in an open position for receiving a portion of the film.
Figure 6:
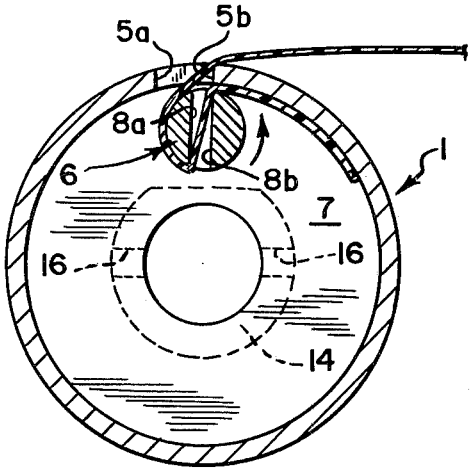
FIG. 6 shows a mechanism of FIG. 5 in a closed position with the film secured to the reel.

The film take-up reel, as shown in FIG. 1 is a hollow cylinder spool 2 whose cylindrical walls define an inner surface 3 and an outer surface 4. A longitudinal slot 5 extends substantially the entire length of the spool parallel with the spool axis and is cut through both the inner and outer surface of the cylindrical walls. The length of the spool slot 5 is slightly larger than the width of the film used, and is sufficiently wide to readily receive the film therethrough. The width of the spool slot 5 as defined by edges 5*a*, 5*b* is small in comparison with the diameter of the spool but is relatively larger in comparison with the thickness of the film as can be seen in FIGS. 5 and 6. Adjacent the slot at the inner surface of the spool a tightening shaft 6 is rotatably secured to end wall 7 defined at each end of the spool. The tightening shaft 6 is a solid rod having a shaft slot 8 defined by parallel surfaces 8*a*, 8*b* cut entirely through the axis of the shaft and having a length slightly longer than the spool slot 5. The width as measured between the surfaces 8*a*, 8*b* of the tightening shaft slot 8 is substantially larger than the film thickness but smaller than the spool slot as can be seen in FIGS. 5 and 6.

The location of the axis of tightening shaft 6 is parallel to the axis of the spool with the outer perimeter of the shaft adjacent the inner surface of the spool being displaced from the inner surface a distance slightly greater than the thickness of the film. One surface of the slot when the shaft is rotated to register the shaft slot with the spool shaft is parallel to one surface of the spool slot. With this configuration, when the slots are rotated to register with one another the film can be readily received through both slots as shown in FIG. 5. By rotating the tightening shaft a one-half revolution in a counter-clockwise direction as shown in FIG. 6, several convolutions will be imparted to the film. The cooperation of the film with the spool and tightening shaft as shown in FIG. 6, will secure the film to the reel 1 until the tightening shaft is reversed one-half a revolution to its initial position.

Figure 2:
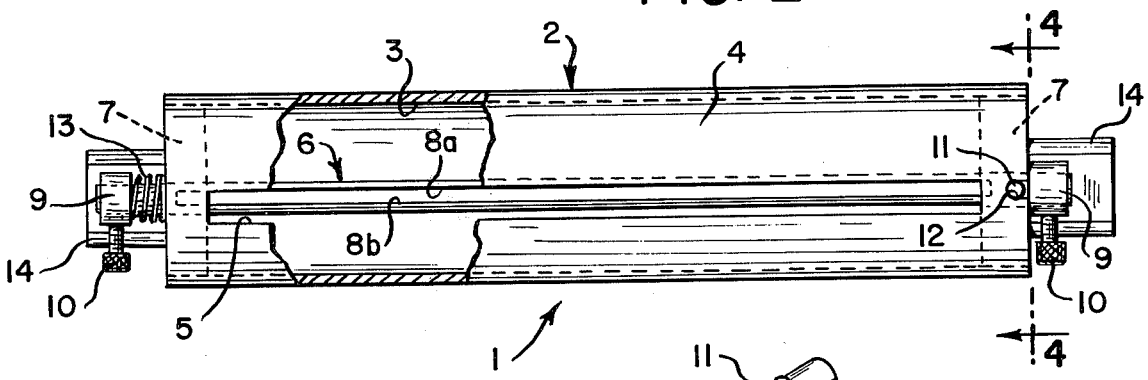
FIG. 2 is a plan view of the film take-up reel with a portion cut away showing the position of the tightening shaft relative to the slot in the spool.
Figure 3:
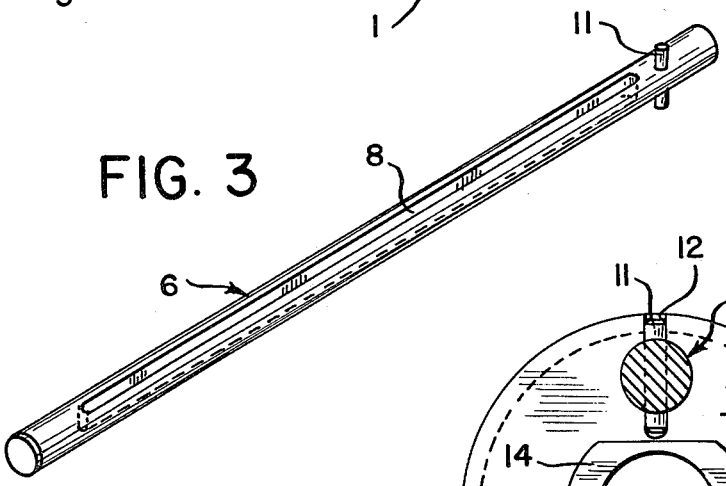
FIG. 3 is a perspective view of the tightening shaft.
Figure 4:
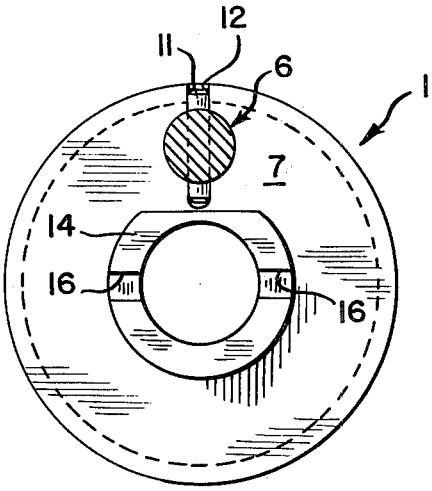
FIG. 4 is a sectional view of FIG. 2 taken along lines 4—4.

To facilitate turning of the tightening shaft for securing the film, the shaft is provided with knobs 9 at each end of the shaft as shown in FIG. 2. To secure the knobs to shaft 6 set screws 10 are threadably secured through the knobs 9 such that when screwed down the knobs will be retained on the shaft by the frictional engagementof the set screw with the tightening shaft. The exposed part of the set screw extends sufficiently beyond the surface of the cylinder walls of the spool for easy accessability by an operator.

To insure uniformity in operation a detent mechanism is used to lock the tightening shaft in the correct position relative to the spool slot 5. The detent mechanism includes a pin 11 extending through the shaft at one end thereof parallel to surfaces 8*a*, 8*b* of the tightening shaft slot 8. At the end of the shaft opposite the end of the pin 11 a spring 13 circumscribes the shaft 6 and is located between the end 7 and the knob 9 for biasing the pin 11 towards a groove 12 in the cylinder wall. With this configuration the tightening shaft cannot be rotated until the spring bias is overcome forcing the pin 11 out of the groove 12. Upon rotating the tightening shaft the spring bias will automatically stop the rotation by forcing the pin 11 back into groove 12 once the one-half revolution has been completed. This operation insures that minimum amount of film is used in tightening the film to the film take-up reel. As can be seen in FIG. 5, a maximum amount of film used is that which is approximately equal to the diameter of the spool. Further, the detent mechanism insures that approximately the same amount of film will be used for securing purposes regardless of the operator, thus, eliminating the waste which would otherwise occur.

Figure 7:
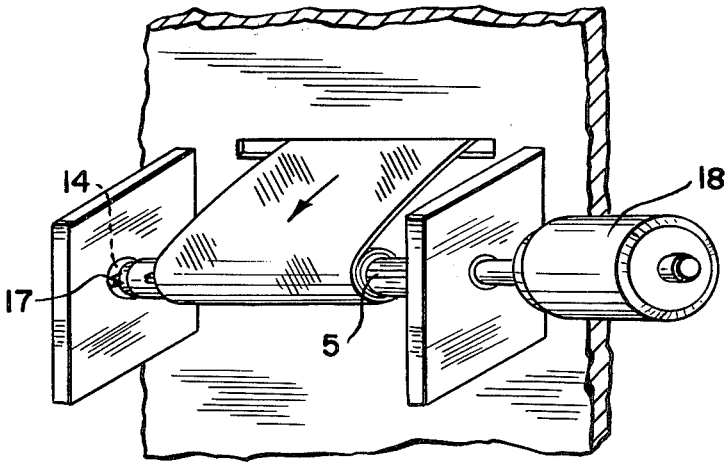
FIG. 7 shows the take-up reel secured to the cassette of a phototypesetting apparatus.

At the ends 7 of the spool 2 there are provided bosses 14 for securing the spools to the cassette of a phototypesetting apparatus. The bosses are generally cylindrical in configuration defining a flat portion such that there will be no interference of the boss with the knobs 9 during rotation of the tightening shaft. These bosses 14 define a female portion 16 and a keyway 17 for cooperating with complementary members in a cassette. The cassette has one complementary portion which is attached to a motor 18 shown in FIG. 7. To install the film take-up reel one boss is slid into engagement with the complementary member attached to the motor 18; the other boss is moved into position where another complementary member is moved into engagement and locked into place for securing the cylinder to the cassette. The details of the complementary portions and their operation are not disclosed as they are readily available to one skilled in the art.

In operation, the film take-up reel is slid into the cassette and locked rotatably to the motor as discussed above. The film after having been loaded into the camera and passed through to the exit slot is inserted through the spool and tightening shaft slots as shown in FIG. 5. The knob 9 is then moved to overcome the bias of the spring to disengage pin 11 with groove 12. The knobs 9 are then simply rotated in a counterclockwise direction until pin 11 engages groove 12 preventing further rotation. Once the film has been exposed and wound on the take-up reel the take-up reel is disengaged from the cassette and placed on a bracket device where the film can be played out for developing. Prior to playing out the film for developing the tightening shaft can be moved to the open position allowing the film to be released from the reel when the end of the film attached to the reel is reached. In this manner the operator, having placed the reel in the bracket and moved the tightening shaft to an open position, need not attend to the reel as the film is played out for developing.

The mechanism is one which insures that each operator will secure the film to the reel in a uniform manner. The elements employed are easy to manufacture and assemble while providing a unique means of securing film to a reel. The device described above has eliminated the multiplicity and complexity of parts which have characterized other reels used heretofore to take-up film or similar sheet material. With operation of the device described herein a significant amount of waste film is eliminated without loss of efficiency in the manner in which the film is secured to the take-up reel.

I claim:

1. A film take-up reel having a hollow spool member with a longitudinal slot for receiving the film wherein said spool member defines an outer surface and an inner surface comprising:

a. a tightening shaft member rotatably secured adjacent the hollow spool member and having an effective diameter substantially less than the effective diameter of the spool member;

b. said spool member defining a slot extending substantially the entire length of the spool member and extending through the outer surface and the inner surface;

c. said tightening shaft member being rotatably secured adjacent said slot and registering with said slot along the internal surface of said spool;

d. said tightening shaft member having a shaft slot extending entirely therethrough and registering with said spool slot for receiving a portion of the film when in a predetermined open position; and e. said shaft slot cooperating with said spool slot for imparting convolutions to the film by rotation of said shaft to a predetermined closed position to secure the film to the spool the open and closed positions being maintainable in the absence of a portion of film.

2. The film take-up reel according to claim 1 wherein said shaft member having an outer shaft surface and being located such that the outer shaft surface adjacent the inner surface of the spool is displaced from the inner surface of the spool a distance slightly greater than the thickness of the film.

3. The film take-up reel according to claim 2 wherein the axis of the shaft member is located between the axis of the spool and the inner surface of the spool in the vicinity of the spool slot.

4. The film take-up reel according to claim 3 further comprising a detent means for holding the tightening shaft member in an open position for receiving the film and in a closed position for securing the film to the spool.

5. The film take-up reel according to claim 4 wherein said detent means includes a pin extending entirely through the tightening shaft member, a groove in the spool surface for engagement with said pin; a spring means for biasing the pin toward the groove such that rotation of the tightening shaft member cannot be accomplished until the bias of the spring is overcome to displace the pin from the groove allowing rotation of the shaft.

6. The film take-up reel according to claim 5 wherein at least one knob member is fixed to the tightening shaft thereby enabling an operator to rotate said tightening shaft member relative to the spool.

7. The film take-up reel according to claim 6 wherein said spool defines an end member located at each end of the spool, a boss extends from each end member having engaging means for rotatably securing the spool in a cassette.

8. The film take-up reel according to claim 7 wherein said reel is configured for operation in a phototypesetting apparatus having a camera for exposing film passed through the camera, wherein said engaging means cooperates with complementary engaging means defined by the cassette in said phototypesetting apparatus for taking up exposed film as said film is played off from the camera.

9. The film take-up reel according to claim 8 wherein engaging means includes a cylindrical boss extending from each end member and having an axis coextensive with the axis of said spool, said boss having a female portion defined in an unsupported part of said boss for receiving a male portion in the complementary engaging means defined by said cassette.

10. The film take-up reel according to claim 9 wherein said spool slot is defined by two substantially parallel spool slot surfaces, said shaft slot being defined by two substantially parallel shaft slot surfaces, one of said shaft slot surfaces lying substantially in the same plane as one of said spool slot surfaces.

11. The film take-up reel according to claim 10 wherein said shaft member is rotatable from the closed position to the open position with film wound about the spool for allowing release of the film before the film has been entirely played off from the film take-up reel.

12. A film take-up reel having a hollow spool member with a longitudinal slot for receiving the film wherein said spool member defines an outer surface and an inner surface comprising:

a. a tightening shaft member having an effective diameter substantially less than the effective diameter of the spool member;

b. said spool member defining a slot extending substantially the entire length of the spool member and extending through the outer surface and the inner surface;

c. said tightening shaft member being rotatably secured adjacent said slot and registering with said slot along the internal surface of said spool;

d. said tightening shaft member having a shaft slot extending entirely therethrough and registering with said spool slot for receiving a portion of the film;

e. said shaft slot cooperating with said spool slot for imparting convolutions to the film by rotation of said shaft to secure the film to the spool;

f. said shaft member having an axis located between the inner surface of the spool and the axis of the spool in the vicinity of the spool slot, said shaft member defining an outer shaft surface being displaced from the inner surface of the spool a distance slightly greater than the thickness of the film;

g. said shaft member being rotatable between an open position for receiving and releasing the film and a closed position for securing the film to the spool; and h. a detent means cooperating with said shaft member and said spool member for holding the shaft member in an open position to receive the film and in a closed position to secure the film to the spool.

13. A film take-up reel having a hollow spool member with a longitudinal slot for receiving the film wherein said spool member defines an outer surface and an inner surface comprising:

a. a tightening shaft member having an effective diameter substantially less than the effective diameter of the spool member;

b. said spool member defining a slot extending substantially the entire length of the spool member and extending through the outer surface and the inner surface;

c. said tightening shaft member being rotatably secured adjacent said slot and registering with said slot along the internal surface of said spool;

d. said tightening shaft member having a shaft slot extending entirely therethrough and registering with said spool slot for receiving a portion of the film;

e. said shaft slot cooperating with said spool slot for imparting convolutions to the film by rotation of said shaft to secure the film to the spool; and f. a detent means for holding the tightening shaft member in at least one predetermined position.

14. A film take-up reel having a hollow spool member with a longitudinal slot for receiving the film wherein said spool member defines an outer surface and an inner surface comprising:

a. a tightening shaft member having an effective diameter substantially less than the effective diameter of the spool member;

b. said spool member defining a slot extending substantially the entire length of the spool member and extending through the outer surface and the inner surface;

c. said tightening shaft member being rotatably secured adjacent said slot and registering with said slot along the internal surface of said spool;

d. said tightening shaft member having a shaft slot extending entirely therethrough and registering with said spool for receiving a portion of the film, said shaft slot cooperating with said spool slot for imparting convolutions to the film by rotation of said shaft to secure the film to the spool; and e. a detent means for holding the tightening shaft member in an open position for receiving the film and in a closed position for securing the film, said detent means having a pin extending entirely through the tightening shaft member, a groove in the spool surface for engagement with said pin, a spring means for biasing the pin toward the groove in a manner such that rotation of the tightening shaft member cannot be accomplished until the bias of the spring is overcome to displace the pin from the groove allowing rotation of the shaft.

* * * * *